US008576215B2

(12) United States Patent
Markvoort et al.

(10) Patent No.: US 8,576,215 B2
(45) Date of Patent: Nov. 5, 2013

(54) METHOD OF CONTROLLING AN ELECTRONIC DISPLAY AND AN APPARATUS COMPRISING AN ELECTRONIC DISPLAY

(75) Inventors: Wieger Markvoort, Enter (NL); Erik van Veenendaal, Eindhoven (NL)

(73) Assignee: Creator Technology B.V., Breda (NL)

( * ) Notice: Subject to any disclaimer, the term of this patent is extended or adjusted under 35 U.S.C. 154(b) by 437 days.

(21) Appl. No.: 12/747,852

(22) PCT Filed: Dec. 15, 2008

(86) PCT No.: PCT/NL2008/050801

§ 371 (c)(1),
(2), (4) Date: Dec. 7, 2010

(87) PCT Pub. No.: WO2009/078711

PCT Pub. Date: Jun. 25, 2009

(65) Prior Publication Data

US 2011/0074756 A1 Mar. 31, 2011

Related U.S. Application Data

(60) Provisional application No. 61/013,911, filed on Dec. 14, 2007.

(51) Int. Cl.
*G09G 5/00* (2006.01)

(52) U.S. Cl.
USPC ..... 345/211; 345/107

(58) Field of Classification Search
USPC ..... 345/211, 212, 107, 55; 368/82
See application file for complete search history.

(56) References Cited

U.S. PATENT DOCUMENTS

| | | | | |
|---|---|---|---|---|
| 2003/0026171 | A1 * | 2/2003 | Brewer et al. | 368/82 |
| 2003/0137521 | A1 | 7/2003 | Zehner et al. | |
| 2006/0050050 | A1 * | 3/2006 | Zhou et al. | 345/107 |
| 2006/0170648 | A1 * | 8/2006 | Zhou et al. | 345/107 |
| 2007/0273637 | A1 | 11/2007 | Zhou et al. | |

FOREIGN PATENT DOCUMENTS

| | | | |
|---|---|---|---|
| WO | WO 2006/134560 | A | 12/2006 |
| WO | WO 2006/134560 | A1 | 12/2006 |

OTHER PUBLICATIONS

China Patent Office, Office Action, Patent Application U.S. Appl. No. 200880124851.X, May 21, 2012, China.
International Search Report for PCT/NL2008/050801 dated Apr. 23, 2009.

* cited by examiner

*Primary Examiner* — Quan-Zhen Wang
*Assistant Examiner* — Yuk Chow

(57) ABSTRACT

A method of controlling an electronic display having a plurality of pixels settable in a first operating level, a second operating level and an intermediate operating level, the method comprising the step of setting the pixels in a preparatory intermediate operating level immediately prior to setting the pixels in a desired intermediate operating state. At an end of a frame i−1, for example, it is possible to drive a pixel from a level P0 further towards white to reach reflection level Pn or to stop driving it, or to switch a control voltage to an apposite polarity and arrive at a lower level. Levels P1 and P2 present embodiments of preparatory intermediate levels used to drive pixels in accordance with the invention. For example, levels 2, 4, and 6 may be obtained from the preparatory level P1. Levels 3, 5, and 7 may be obtained from the preparatory level P2.

14 Claims, 5 Drawing Sheets

Figure 1A:
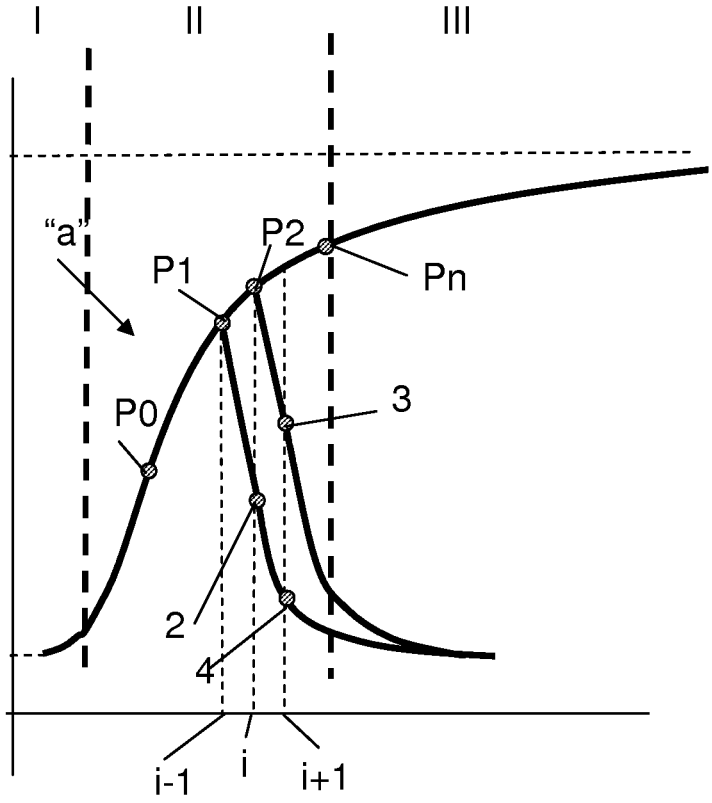

METHOD OF CONTROLLING AN ELECTRONIC DISPLAY AND AN APPARATUS COMPRISING AN ELECTRONIC DISPLAY

FIELD OF THE INVENTION

The invention relates to a method of controlling an electronic display. More particularly, the invention relates to a method of controlling an electrophoretic display. The invention further relates to an apparatus comprising an electronic display. More particularly, the invention relates to an apparatus comprising a flexible electronic display.

BACKGROUND OF THE INVENTION

Electronic displays have a plurality of pixels, which may be settable with a first operating reflection level, a second operating reflection level and an intermediate operating reflection level. Usually, the first level relates to "white", the second level relates to "black" and the intermediate level relates to "grey". For example, electronic displays may be based on a per se known electrophoretic material comprising capsules with black and white particles. In order to change image content on an electrophoretic display, new image information is written for a certain amount of time, for example during a period of 300 ms-600 ms. The refresh rate of the active-matrix is usually higher (for example 20 ms frame time for a 50 Hz display and 10 ms frame time for a 100 Hz display). Changing pixels of such display from black to white, for example, requires the pixel capacitors to be charged to a suitable control voltage for 300 ms to 600 ms, in the case where a pulse-width modulation principle is used. During this time the white particles drift towards the top (common) electrode, while the black particles drift towards the bottom electrode, for example an active-matrix back plane. Switching to black requires a control voltage of a different polarity, and applying substantially 0 V on the pixel substantially preserves its condition. Addressing such electrophoretic display for a short time with a certain voltage will result in a situation that a mixture of white and black particles is visible. Because the particles are very small human eyes integrate various ratios of black and white particles to shades/levels of grey. Such condition is regarded as an intermediate reflection level.

Pixels of the known electrophoretic display have a limited bit depth. For example, a 3 bit pixel has $2^3=8$ grey levels. In order to enable 16 levels (distinct shades) the pixels have to be controlled with a 4-bit driving scheme.

For the known electronic display for an equidistant partition of a full dynamic range of a pixel (e.g, between lightest to darkest shades), increasing the bit depth could require increasing the frame rate. Increasing the frame rate generally increases power consumption and potentially leads to a shorter product lifetime. Also, increasing the bit depth requires a higher accuracy and robustness of the method to control the display used to obtain the equidistant partitioning of the dynamic range.

SUMMARY OF THE INVENTION

It is an object of the invention to provide a method for controlling an electronic display providing an increase in a pixel's bit depth without increasing frame rate and compromising on the robustness.

To this end a method of controlling an electronic display having a plurality of pixels settable in a plurality of reflection levels comprising a first level, a second level and a plurality of intermediate levels, said intermediate levels forming a substantially equidistant partition of a dynamic range between the first level and the second level, the method comprising the step of setting the pixels in at least one preparatory intermediate level immediately prior to setting the pixels in a desired level selectable from said plurality of levels.

The technical measure of the invention is particularly applicable to the pulse-width modulation drive scheme. It is based on the insight that a change in reflection (i.e. going from white to black or from black to white) per frame is typically dependent on the current grey level and driving history. The reflection levels in a direction from a low reflection (nearly black) to a high reflection (nearly white) change in a non-linear way. Three ranges of a typical reflection curve for a given electrophoretic material may be defined. Initially, a relatively slow change of the reflection occurs, i.e. low derivative. After a certain percentage of the reflection is reached, the rate of change of reflection potentially increases, i.e. increased derivative. Finally, close to a maximum reflection level a change in reflection may decrease again, i.e. lower derivative. It is understood that in a case where the control voltage is changed to a control voltage of an opposite polarity prior to reaching a maximum (or minimum) reflectivity (white state/black state) of such bi-stable material, a decrease (or increase) in reflectivity may take place following a different curve. This is explained in further detail with reference to FIGS. 1*a* and 1*b*.

It has been found that for enabling robust performance of an electrophoretic display with respect to producing pixel's grey levels, it is advantageous to drive the display to the final grey level via a preparatory intermediate grey level. The preparatory intermediate grey level is preferably selected in a region of a maximum slope or slightly beyond of the reflectivity curve.

In an illustrative embodiment of the method according to the invention, the method comprises the steps of:

- providing a first preparatory intermediate level and a second preparatory intermediate level;
- assigning each intermediate level to either the first preparatory intermediate level or the second preparatory intermediate level.

It is found that in cases where these preparatory intermediate levels are close to each other, a substantially equidistant partition of the dynamic range is obtained while increasing a pixel's bit depth and without the need to increase the frame rate. In addition, when the two preparatory intermediate states are close, the image update is robust against performance degradation, which is advantageous. To be able to create multiple levels close to each other the reflection change should be preferably gradual per frame. An example is given in FIGS. 1*a* and 1*b*. Each respective desired intermediate level must be assigned to a preparatory intermediate level. Such assignment can be carried out during a suitable calibration step of the electrophoretic material. Preferably, the said assignment is stored in a suitable control module of the display and is accessed during the controlling of the electronic display.

It will be appreciated that the term equidistant partition of the dynamic range' may relate not to a physically equal partition, but to an equidistant partition as perceived by a human eye. It will be appreciated that for this purpose a known human eye sensitivity curve may be used for defining said partition. It is recognized in the art that reflectance (R) is proportional to power and expressed in $Cd/m^2$. The reflectance can be measured as a function of the wavelength of the light. The average reflectance between a wavelength of 350 nm and 780 nm is defined as the total reflectance of the visible light. The relative reflectance is expressed in % with respect to a reference (white for example). Luminance (Y) is the light sensitivity of human vision in $Cd/m^2$. It is derived from reflectance as a function of the wavelength by a convolution with the eye sensitivity curve. The average value is the total luminance of the visible light. The relative luminance is expressed in % and is the luminance with respect to a reference (white for example). Lightness (L*) is the perceptual response to the relative luminance in %. This response is roughly logarithmic. A delta L* of unity is taken to be roughly the threshold of visibility. Grey levels in a display are preferably generated equidistant with respect to lightness L*.

The pixels are usually addressed by an application of a constant voltage during a frame time. Preferably, the first preparatory intermediate level and the second preparatory intermediate level being spaced from each other on said curve by one or two frame times. For 50 Hz addressing, the frame time is 20 ms and for 100 Hz addressing the frame time is 10 ms. However, the frame time may have any value in a range between 4 ms to 250 ms.

With this feature it is possible to enable an equidistant grey scale (scale of presented grey shades between a lightest and darkest level for a single pixel) without increasing a frame rate, because the preparatory intermediate levels are selected in such a way that the reflectivity changes substantially exactly to a desired value within a duration of one frame or two frames. In this way protection against degradation is obtained and is accompanied by an improved reproducibility of generation of multiple grey levels.

Preferably a first partition and a second partition are enabled, wherein the first partition is potentially a fine partition and the second partition is potentially a coarse partition. For example, a coarse partition may have a difference between respective sub-levels in the dynamic range about two times or more, compared to the fine partition. It is further possible that a control means of the display allows a user or application to select between the coarse partition and the fine partition (for example, to select between 8 grey levels and 16 grey levels) depending on a type of image to be projected on the display. For example, to present textual information it may be sufficient to use a lower (coarse) partition, while for presenting an image or the like the user may choose a fine partition, for example for 16-levels or even higher.

In a further illustrative embodiment of the method according to the invention, the method further comprises the steps of:

- analyzing a pixel reflection level distribution for subsequent images along at least a portion of pixels of the electronic display;
- determining a longest drive pathway for a pixel from said portion;
- adjusting a drive scheme for the said portion in accordance with the longest drive pathway.

This technical measure is based on the insight that in order to enable a good quality image on the display it is advantageous to take due account of both a current grey level of the electrophoretic material and a desired grey level of the electrophoretic material. By defining a transition from a certain grey level to a new grey level results in an improved drive scheme, which is shortened with respect to a conventional drive scheme. It is noted that a display update will always have a duration corresponding to duration of the longest transition in an envisaged drive scheme, see for example FIG. 2*a*. By comparing pixel content of a previous and a subsequent image and by defining the pixel content dependent drive schemes, an improvement, i.e. a decrease of the frame duration may be obtained. This may be realized by removing the drive scheme descriptions of transitions that do not occur between the current and the subsequent image. This feature is discussed in more detail with reference to FIG. 2*b*.

BRIEF DESCRIPTION

FIG. 1*a* presents a schematic view of a typical reflectivity curve for an electrophoretic display when changing from black to white.

Figure 1B:
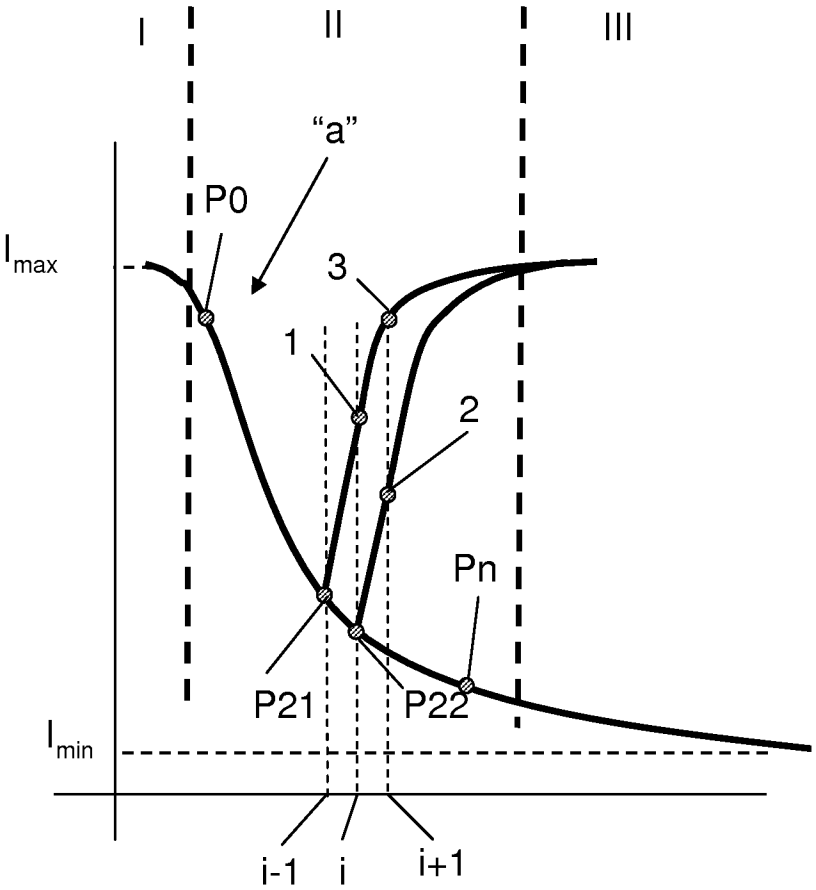

FIG. 1*b* presents a schematic view of a typical reflectivity curve for an electrophoretic display when changing from white to black.

Figure 2A:
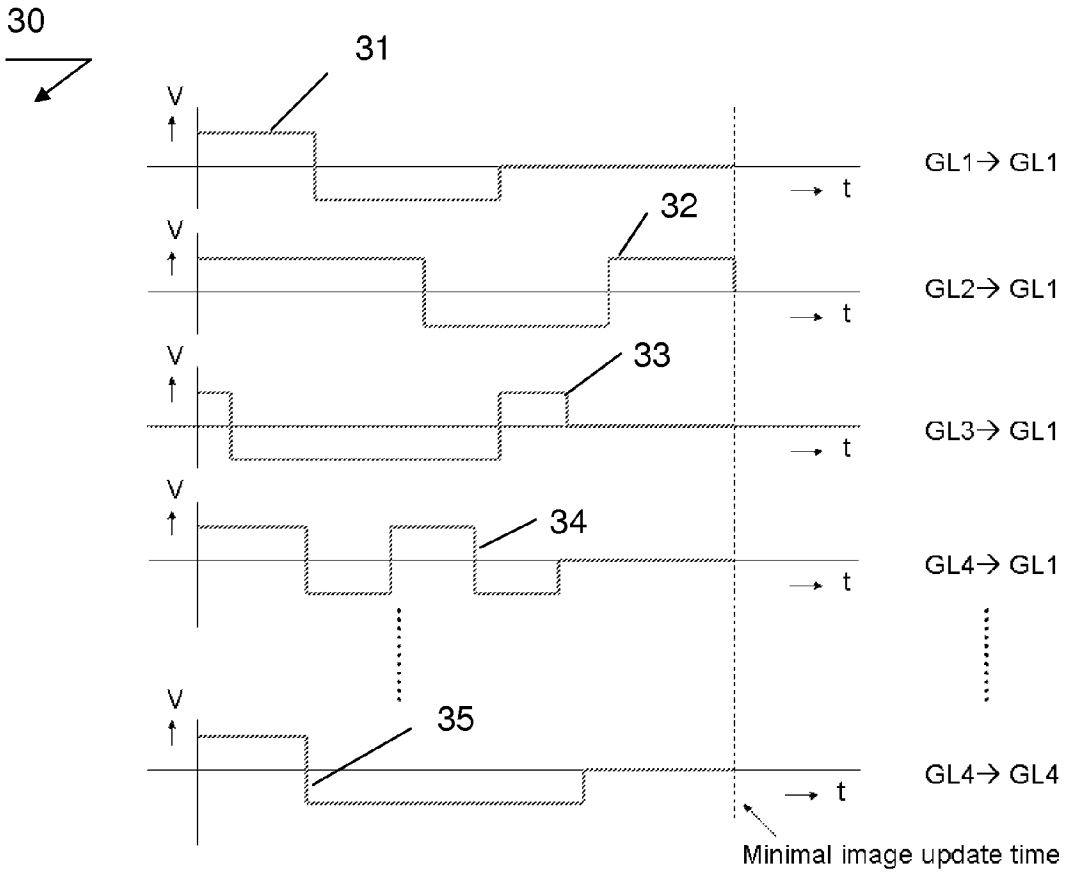

FIG. 2*a* presents a schematic representation of an embodiment of a drive scheme of an electrophoretic display.

Figure 2B:
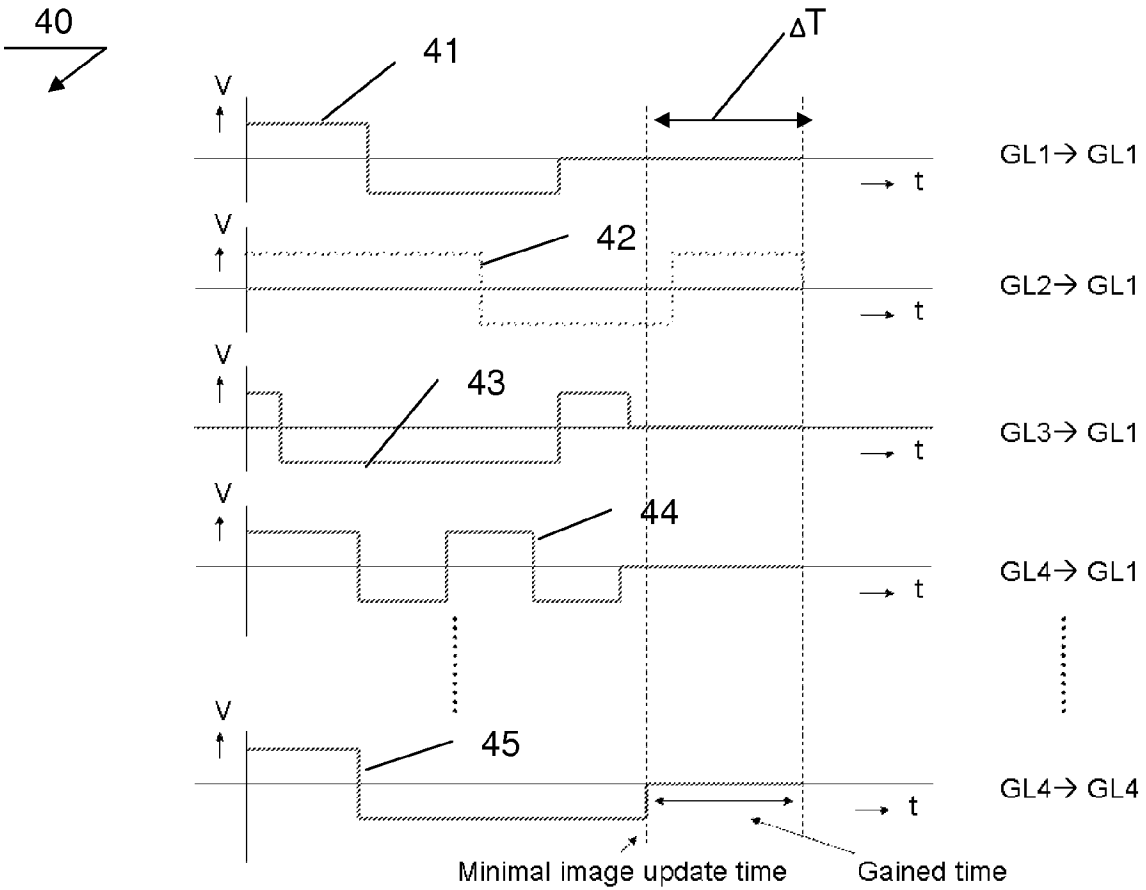

FIG. 2*b* presents a schematic representation of an embodiment of an improved drive scheme of an electrophoretic display in accordance with the invention.

Figure 3:
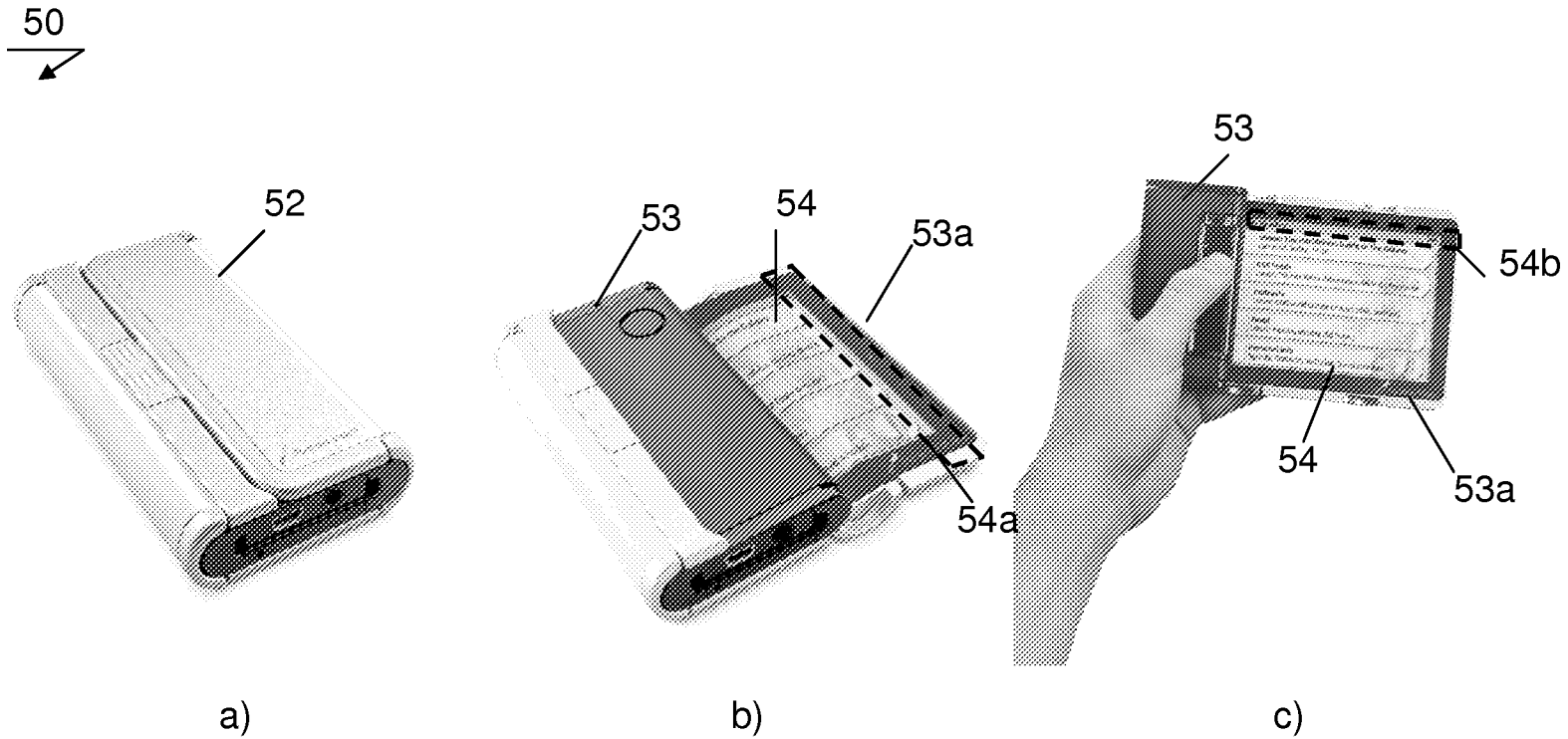

FIG. 3 presents a schematic view of an embodiment of an electronic apparatus comprising a flexible display.

DETAILED DESCRIPTION

FIG. 1*a* presents a schematic view of a typical reflectivity curve for an electrophoretic display when changing from black to white. A reflection curve "a" has three identifiable regions. Initially, in a region I, a relatively slow change of the reflection occurs, i.e. low derivative. After a certain percentage of the reflection is reached in region II, a change in reflection per applied voltage (abscissa) may have a steep portion, characterized by an increased derivative. Finally, in region III close to a maximum reflection level $I_{max}$, a change in reflection may decrease again, i.e. lower derivative. It is understood that in the case where a control voltage is alternated to a control voltage of an opposite polarity prior to reaching a maximum reflectivity $I_{max}$ (white state) of a suitable display, for example comprising an electrophoretic display, a decrease in reflectivity may take place following a different curve, for example curve "b" or curve "c". Usually, this different curve has a different derivative than the curve "a" characterizing an increase in reflectivity. However, such curve also has three characteristic regions, whereby a central region has a steep portion. The term "steep portion" is herewith applicable either to an increasing reflectivity, or to a decreasing reflectivity.

Turning now to FIG. 1*a*, explaining the principle of the invention. Curve "a" schematically illustrates a reflection curve when a control voltage is applied to an electrophoretic capsule causing an increase of its reflection. It is possible to drive a pixel from a level $P_0$ further towards white to reach reflection level Pn or to stop driving it, or to switch a control voltage to an opposite polarity and arrive at a lower level. Levels P1 and P2 present embodiments of preparatory intermediate levels used to drive pixels in accordance with the invention. For example, levels 2 and 4 may be obtained from the preparatory level P1. Level 3 may be obtained from the preparatory level P2. It will be appreciated that in practice a suitable plurality of levels may be enabled, for example 8 levels, 16 level or even more levels. It is also possible that a sole preparatory intermediate level (not shown) is used to obtain at least all desired intermediate levels. It is also possible that the at least one preparatory intermediate level is used to obtain the first level (white) and the second level (black). Depending on which intermediate reflection level is chosen at a frame "i" or "i–1" it is possible to reach level 3 (starting from level P2), or levels 2 and 4, (starting from level P1). It is noted that it is impossible (in view of a minimum frame time) to reach level "3" starting from level P1. It is also impossible to reach the reflection level at point "4" starting from level P2. Therefore, each respective desired intermediate level must be assigned to a specific preparatory intermediate level. Such assignment can be carried out during a suitable calibration step of the electrophoretic material. Preferably, the said assignment is stored and is accessed during the controlling of the electronic display. Preferably, a limited number of preparatory intermediate levels is selected, for example two.

These preparatory intermediate levels are preferably selected in a vicinity of each other, at an end portion of the steep region II, preferably within one or two frame times. Levels P1 and P2 represent embodiments of such two preparatory intermediate levels. This has an advantage that a better partition of a dynamic region of a display's pixel may be achieved compared to a situation when a sole preparatory intermediate level is selected for all grey levels of the pixel. It will be appreciated that within a plurality of pixels constituting an active area of a display some pixels would not require any driving from the preparatory intermediate level. For these pixels it is assumed that a transition between the preparatory intermediate level and a desired intermediate level is a zero transition.

FIG. 1*b* presents a schematic view of a typical reflectivity curve for an electrophoretic display when changing from white to black, whereby level P0 represents a higher reflection value than level Pn. An embodiment shown in FIG. 1*b* represents an alternative way of driving an electrophoretic material. In this case an initial state of a pixel is white, corresponding to a substantially maximum reflection of the pixel. The curve "a'" schematically illustrates a reflection curve when a control voltage is applied to an electrophoretic capsule causing a decrease of its reflection. Similarly to a situation sketched in FIG. 1*a*, certain preparatory intermediate levels at frames "i−1", "i", for example P21 and P22, lead to different reachable reflection levels—intermediate levels 1 and 3, for the preparatory intermediate level P1 and intermediate level 2 for the preparatory intermediate level P2. It will be appreciated that the discussed reflection curves with reference to FIGS. 1*a* and 1*b* are substantially similar for all capsules constituting an electrophoretic material.

FIG. 2*a* presents a schematic representation of an embodiment of a drive scheme of an electrophoretic display. An exemplary drive scheme 30 comprises a number of drive sequences 31, 32, 33, 34, and 35 for causing a transition between an initial reflection level of a pixel reflection and a final reflection level of a pixel. For example, sequences 31 and 35 are arranged to keep a grey level of a pixel constant. The sequence 32 is arranged to cause a pixel reflection to change from a starting level to an end level. In accordance with the invention such transition is carried out via a preparatory intermediate level. Sequences 33 and 34 are arranged for causing pixel reflection to decrease from a higher level to a lower level, the lobes of these sequences correspond to a required duration of a control voltage of certain polarity for enabling such transition.

From the exemplary illustration of FIG. 2*a* it follows that update time for the selected transitions is determined by a longest sequence, in this case the sequence 32. In order to balance respective update times of other sequences a zero interval Vo is added at the end of each sequence. Such zero interval may be seen as a waiting mode, wherein the particles in respective capsules have stopped moving.

In accordance with the further aspect of the invention, first a pixel reflection level distribution for subsequent images along at least a portion of pixels of the electronic display is analyzed followed by a determination of a longest drive pathway for a pixel from said portion, after which the drive scheme for the said portion is adjusted in accordance with the longest drive pathway. A resultant effective drive scheme is shown in FIG. 2*b*. It will be appreciated that a plurality of feasible possibilities is available for performing such analyzing and such determination. For example a suitable control means (e.g., any of a variety of electronic control logic and memory including microcontrollers, microprocessors, ASICs, etc.) of the electronic display may be arranged to store current values of the grey levels of all pixels constituting a current image. When a new image is about to be generated on the display, the control means, for example, compares individual grey level increments (positive or negative) for all pixels. After this the thus determined increments are converted into corresponding individual drive schemes, wherein a longest path can be identified.

FIG. 2*b* presents a schematic representation of an embodiment of an improved drive scheme of an electrophoretic display in accordance with the invention. An exemplary embodiment of an optimized driving scheme 40 for a number of pixels comprises sequences 41, 43, 44, and 45. It is shown that in case it is determined that a sequence 42 is not present, the other sequences may be adapted to match the longest sequence among the present sequences.

In this example sequence 45 constitutes such longest sequence. As a result a time gain ΔT is obtained for the frame duration. It is found that shortening of the frame duration has an advantage of reduced power consumption of the electronic display and provides faster image update with substantially the same image performance with regard to resolution and contrast.

FIG. 3 presents a schematic view of an embodiment of an electronic apparatus comprising a flexible display. The electronic apparatus 50 may relate to a mobile phone, a palmtop computer, an electronic organizer, or any other portable electronic device comprising a display cooperating with a housing 52. It is noted that for the display a flexible display may be used. For the latter, the housing 52 may be arranged to be unfoldable and wrappable about a core 53, whereby the flexible display 54 may be conceived to be extended from its collapsed state into an extended state upon use. In order to support the flexible display during use and to protect it from mechanical damage, the housing 52 may comprise rigid portions 53*a* conceived to at least partially receive and/or support edge portions of the flexible display 54*a*, 54*b*. It will be appreciated that during folding and unfolding of the housing 52 some parts of the flexible display 54 undergo deformation, whereas other parts of the flexible display undergo substantially no deformation. In an alternative embodiment of the electronic apparatus according to the invention comprising a flexible display, the flexible display may be arranged to be rollable about a suitable roller arranged in the housing 52. In this case a leading end of the flexible display may be provided with a grip portion for enabling a user to extend the rolled-up flexible display during use. Alternatively, both end portions of the flexible display may be arranged on respective rollers so that the flexible display is extended upon a relative movement of these end portions away from each other. It will be appreciated that other embodiments of the electronic apparatus comprising the flexible display are possible.

It will be appreciated that while specific embodiments of the invention have been described above, that the invention may be practiced otherwise than as described. In addition, isolated features discussed with reference to different figures may be combined.

The invention claimed is:

1. A method of controlling an electronic display having a plurality of pixels settable in a plurality of reflection levels comprising a first level, a second level and a plurality of intermediate levels, said intermediate levels forming a substantially equidistant partition of a dynamic range between the first level and the second level, the method comprising the steps of:

setting the pixels in at least one preparatory intermediate level immediately prior to performing a subsequent step of setting the pixels in a desired level selectable from said plurality of reflection levels, wherein:

the pixels are settable in the plurality of reflection levels by a pulse-width modulation of a voltage applicable to said pixels;

a first preparatory intermediate level and a second preparatory intermediate level are provided, and each intermediate level is assigned to either the first preparatory intermediate level or the second preparatory intermediate level; and the first preparatory intermediate level and the second preparatory intermediate level are spaced from each other on a curve by one or two frame times, the curve showing reflectivity variation as a function of the time the voltage is applied.

2. The method according to claim 1, wherein the first level is white, the second level is black and the intermediate level is grey.

3. The method according to claim 1, wherein the curve comprises a steep region, and a position of said at least one preparatory intermediate level is selected substantially at an end portion of said steep region.

4. The method according to claim 1, wherein the frame time is in the range of 4 ms to 250 ms.

5. The method according to claim 1, further comprising the steps of:

analyzing a pixel reflection level distribution for subsequent images along at least a portion of pixels of the electronic display;

determining a longest drive pathway for a pixel from said portion; and adjusting a drive scheme for the said portion in accordance with the longest drive pathway.

6. The method according to claim 5, wherein during the step of analyzing a pixel reflection level, profiles for subsequent images are compared.

7. The method according to claim 1, wherein the curve comprises a steep region and a position of said at least one preparatory intermediate level is beyond the steep region.

8. An apparatus comprising:

an electronic display with a plurality of pixels settable in a plurality of reflection levels comprising a first level, a second level and a plurality of intermediate levels, wherein said intermediate levels form a substantially equidistant partition of a dynamic range between the first level and the second level;

control means for setting the pixels in the first level, the second level and the plurality of intermediate levels; and wherein the control means is further arranged for setting the pixels in a preparatory intermediate level immediately prior to setting the pixels in a desired level selectable from said plurality of reflection levels;

the pixels are settable in the plurality of reflection levels by a pulse-width modulation of a voltage applicable to said pixels;

a first preparatory intermediate level and a second preparatory intermediate level are provided, and each intermediate level is assigned to either the first preparatory intermediate level or the second preparatory intermediate level; and the first preparatory intermediate level and the second preparatory intermediate level are spaced from each other on a curve by one or two frame times, the curve showing reflectivity variation as a function of the time the voltage is applied.

9. The apparatus according to claim 8, further comprising a computing unit arranged for:

analyzing a pixel reflection level distribution for subsequent images along at least a portion of pixels of the electronic display;

determining a longest drive pathway for a pixel from said portion of pixels of the electronic display; and adjusting a drive scheme for the portion of pixels of the electronic display in accordance with the longest drive pathway.

10. The apparatus according to claim 9, wherein the electronic display is flexible.

11. The apparatus according to claim 9, wherein the electronic display comprises electrophoretic material.

12. The apparatus according to claim 8, wherein the electronic display comprises electrophoretic material.

13. The apparatus according to claim 12, wherein the electronic display is flexible.

14. The apparatus according to claim 8, wherein the electronic display is flexible.

* * * * *